1/28/86 05 4,566,911

United States Patent [19]

Tomita et al.

[11] Patent Number: 4,566,911

[45] Date of Patent: Jan. 28, 1986

[54] METHOD FOR CLEANING ARTICLE BY SCRUBBING WITH CLEANING ROLL

[75] Inventors: Yogi Tomita, Ibaraki; Hisashi Yamamoto, Toyonaka; Susumu Kitagawa, Neyagawa, all of Japan

[73] Assignee: Kanebo Limited, Tokyo, Japan

[21] Appl. No.: 510,988

[22] Filed: Jul. 5, 1983

[30] Foreign Application Priority Data

Jul. 5, 1982 [JP] Japan ..... 57-117432

[51] Int. Cl.[4] ..... B08B 1/04

[52] U.S. Cl. ..... 134/6; 15/230.16

[58] Field of Search ..... 15/230, 230.16; 134/6

[56] References Cited

U.S. PATENT DOCUMENTS 1,094,361 4/1914 Blevney ..... 15/230.16
1,775,186 9/1930 Bartling ..... 15/230.16
3,858,329 1/1975 Koide et al. ..... 34/1
3,915,671 10/1975 Kagawa ..... 51/296

FOREIGN PATENT DOCUMENTS 729868 12/1966 Italy ..... 15/230.16
914315 1/1963 United Kingdom ..... 15/230.16

*Primary Examiner*—Peter Hruskoci
*Assistant Examiner*—W. Gary Jones
*Attorney, Agent, or Firm*—Armstrong, Nikaido, Marmelstein & Kubovcik

[57] ABSTRACT

Effective cleaning of an article can be achieved by a method comprising scrubbing the surface of the article by means of a cleaning roll having a surface layer of polyvinyl acetal porous elastic material having a porosity of 85% to 95%, an average pore opening of 10 to 200 μm, and a 30% compression stress in the state characterized by a water content of 100% based, on the dry weight of the material, of 15 to 150 g/cm$^2$.

6 Claims, 6 Drawing Figures

METHOD FOR CLEANING ARTICLE BY SCRUBBING WITH CLEANING ROLL

BACKGROUND OF THE INVENTION

1. Field of the Invention

The present invention relates to a cleaning method. More particularly, the present invention relates to a method for cleaning an article such as of metal or glass which requires very precise finishing, without damaging the article, by removing particles, such as cuttings, shavings, turnings, abrasive grains, and dust, attached to the surface of the article during the manufacturing process thereof.

2. Description of the Prior Art

In general, the surface of an article such as of metal or glass is finished stepwise using fixed abrasive grains or free abrasives grains to a high precision or polish. In such a process, cuttings from the article being abraded, abrasive grains, or dust in the atmosphere are retained or attached on the surface of the article. It is necessary to remove them at each step by means of a cleaning method.

Conventionally, such an article has been cleaned by scrubbing the surface by a rotating brush roll made of a synthetic fiber, such as a nylon 12 monofilament, formed on the peripheral surface of an elongated stick-like core, while continuously feeding a cleaning liquid such as water, water containing a detergent, or an organic solvent. However, the synthetic monofilament fiber used for such a type of brush roll has poor hydrophilic nature and high rigidity. Thus, the article is often damaged by the cut ends of the fibers of the rotating brush roll, decreasing the yield of the products. Further, it is difficult to scrub the whole surface of the article uniformly by means of a brush roll. Therefore, it is difficult to obtain a satisfactory cleaning effect.

SUMMARY OF THE INVENTION

The inventors have made extensive studies to improve the conventional cleaning method employing a brush roll and have attained the present invention. Thus, the primary object of the present invention is to provide a cleaning method excellent in cleaning effect but not damaging an article to be cleaned.

The present invention provides a method for cleaning an article by removing cuttings, shavings, turnings, abrasive grains, and the like from the surface of the article, comprising scrubbing the surface of the article by means of a cleaning roll having a surface layer of polyvinyl acetal porous elastic material having a porosity of 85% to 95%, an average pore opening of 10 to 200 μm, and a 30% compression stress in the state characterized by a water content of 100%, based on the dry weight of the material, of 15 to 150 g/cm$^2$.

DESCRIPTION OF THE PREFERRED EMBODIMENTS

The performance of the polyvinyl acetal porous elastic material may vary depending upon the type of polyvinyl alcohol employed as a main raw material; the particle size, type, and shape of the foaming agent; the type of aldehyde employed for the conversion of a polyvinyl alcohol to a polyvinyl acetal; the proportions of these reactants; the reaction temperature and time; and the like. However, for attaining the purpose of the present invention, i.e., to ensure that particles attached to the surface of an article are easily and promptly removed by the transfer or adsorption action of the cleaning roll, it is necessary that the cleaning roll have properties as defined above. If the porosity is less than 85%, the polyvinyl acetal porous elastic material may have poor flexibility. If it is more than 95%, the porous elastic material may have poor strength.

If the average pore opening is less than 10 μm, the porous elastic material may have poor elasticity, thus making the performance of the cleaning roll unsatisfactory. If the average pore opening is more than 200 μm, the porous elastic material becomes unsuitable for the cleaning roll because of the bastard pore configuration.

If the 30% compression stress is less than 15 g/cm$^2$, the porous elastic material is too soft, thus developing strain by the rotation of the cleaning roll. If the 30% compression stress is more than 150 g/cm$^2$, the porous elastic material is too rigid, resulting in poor elasticity.

The polyvinyl acetal porous elastic material usable for the method according to the present invention provides excellent cleaning ability by the synergistic action of the high flexibility of said material in a water-containing state and the high hydrophilic nature inherent to the material per se and, in addition, possesses excellent strength and service durability due to the specific porosity, average pore opening, and 30% compression stress as above defined.

Figure 1:
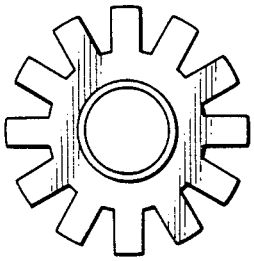
FIG. 1 is a schematic front view of a cleaning roll having a gear-like surface configuration, usable for the present invention.
Figure 2:
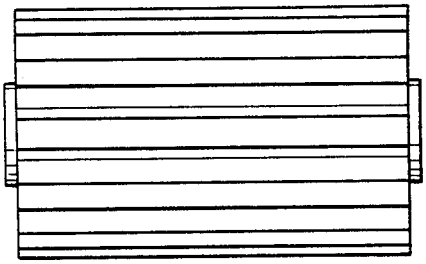
FIG. 2 is a schematic side view of the cleaning roll shown in FIG. 1.
Figure 3:
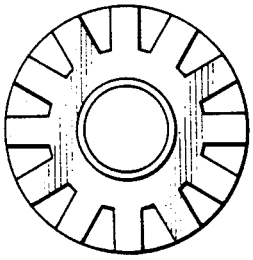
FIG. 3 is a schematic front view of another cleaning roll having a spiral gear-like surface configuration, usable for the present invention.
Figure 4:
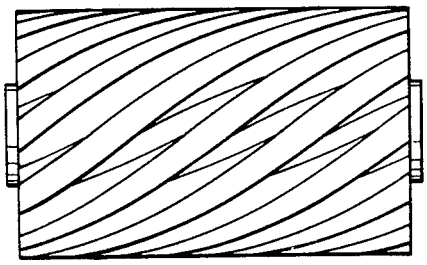
FIG. 4 is a schematic side view of the cleaning roll shown in FIG. 3.
Figure 5:
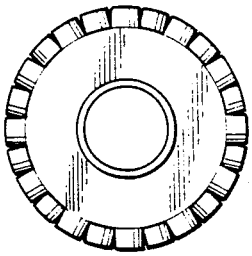
FIG. 5 is a schematic front view of a further cleaning roll having columnar projections on the surface thereof, usable for the present invention.
Figure 6:
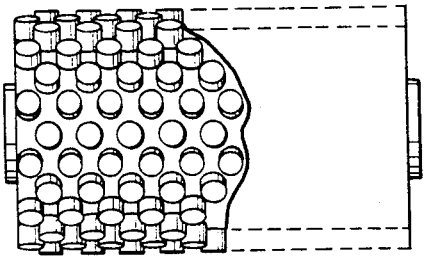
FIG. 6 is a schematic side view of the cleaning roll shown in FIG. 5.

The cleaning roll need not always have a flat surface and may also have the following surface configurations: (a) a gear-like configuration as shown in FIGS. 1 through 4, having many parallel grooves formed at an angle to the roll axis of 0° to 90°, and having a ratio of the width of the bottom end of the gear tooth to the width of the top end of the tooth of not more than 5 and a ratio of the height of the gear tooth to the radius of the roll of not more than 0.8; or (b) a configuration as shown in FIGS. 5 and 6, having many projections of a circular, ellipsoidal, rectangular, or diamond shape or the like and having a total surface area of the projections of 15% to 65% of the whole surface area. Where the above-mentioned ratios are not within the defined ranges, the cleaning roll may have poor gear tooth strength, resulting in unsatisfactory cleaning ability. On the other hand, where the total surface area of the projections is more than 65% of the whole surface area, the article may be damaged. If the total surface area of the projections is less than 15%, the cleaning ability may be poor.

The polyvinyl acetal porous elastic material usable for the present invention may easily be produced in a known manner, for example, by dissolving at least one polyvinyl alcohol having an average degree of polymerization of 300 to 3,000 and a degree of saponification of not less than 80% in water to form a 5% to 30% aqueous solution, adding a foaming agent to the solution, and subjecting the solution to reaction with an aldehyde such as formaldehyde or acetaldehyde until the product becomes water-insoluble. The polymer may preferably have 50 to 70 mole % of acetal units. Where the polymer has less than 50 mole % of acetal units, the retained polyvinyl alcohol may ooze out from the product upon use and undesirably contaminate the article to be cleaned. Where the polymer has more than 70 mole % of acetal units, the product may have poor elasticity and flexibility.

Fine particles attached onto a metal or glass surface are firmly fixed to the surface by intermolecular attraction (van der Waals force) or electrostatic force and, therefore, it is very difficult to remove the particles therefrom. The presence of such fine particles on the surface reduces the product's quality, particularly in modern fine industries. Thus, the precise removal of the fine particles is highly desirable.

The most important feature of the present invention resides in the fact that a polyvinyl acetal porous elastic material excellent in removability of particles from the surface of an article to be cleaned and capable of trapping the removed particles into its pores is applied to the cleaning roll.

The method of the present invention may be practiced, for example, by bringing an article to be cleaned into contact with a cleaning roll being rotated at an appropriate speed, preferably with a contact pressure of not more than 20 g/cm$^2$, while feeding a large amount of a cleaning liquid such as water. In this method, the article is not damaged because of the flexibility and elasticity of the porous elastic material of the cleaning roll. The cleaning liquid may be fed in such a manner as to be injected into the hollow core portion of the cleaning roll and ejected from the pores formed onto the surface portion of the roll.

According to the method of the present invention, a remarkable effect is attained in the removal of relatively large particles having a diameter of more than 30 μm so that they are substantially completely removed from the article surface. Further, in the removal of fine particles having a diameter of less than 5 μm, the present method can attain an effect more than 10 times that attained by using a conventional brush roll. In addition, the article is not damaged by the cleaning procedure.

Furthermore, precise cleaning such as ultrasonic cleaning with the use of an organic solvent or steam cleaning is generally carried out as an after-cleaning step to remove the retained fine particles and/or organic filmy materials. In this connection, the method of the present invention enhances the effect of the precise after-cleaning and, thus, increases the quality and yield of the products.

The present invention will further be illustrated below in reference to the following non-limitative examples.

EXAMPLE 1

A square copper plate of 4×4 in. having a Rockwell hardness of HRB-70 was abraded with free abrasive grain of 1,000 grit, washed with running water, and left to stand at room temperature for 24 hours. The copper plate was then subjected to the following cleaning test using a cleaning roll according to the present invention.

Pure water subjected to particle control was used as a cleaning liquid. The copper plate to be cleaned was moved at a speed of 5 m/min and brought into contact with the cleaning roll rotated at a rate of 200 rpm with a contact pressure of 5 g/cm$^2$. The pure water was sprinkled over the copper plate before and after the contact with the cleaning roll. The cleaning roll had a diameter of 60 mm, a length of 150 mm and a surface layer of polyvinyl acetal porous elastic material having a porosity of 90% and an average pore opening of 120 μm. The surface layer had a flat surface, and the 30% compression stress of the porous elastic material was 60 g/cm$^2$ in the state of a water content of 100% based on the dry weight of the elastic material.

After cleaning, the surface of the copper plate was observed using a metallurgical microscope at a magnitude of 50 to count the number of the particles still retained on the surface. The test was repeated 10 times and the average number of the retained particles was recorded. Further, the surface of the copper plate was observed under a light of 10,000 candela to evaluate the presence of scratch marks.

The results are shown in Table 1.

EXAMPLE 2

The procedure used in Example 1 was repeated, except that the following cleaning roll was used. The results as shown in Table 1 were obtained.

The used cleaning roll had the same material and size as those of the cleaning roll used in Example 1. However, the roll had a surface configuration as illustrated in FIGS. 5 and 6 in which the projections had a height of 4 mm, a diameter of 8 mm, and an area of 0.5 cm$^2$. The projections were arranged in a regular zigzag form and the total surface area of the projections was 35% of the whole surface area of the cleaing roll.

COMPARATIVE EXAMPLE

The procedure used in Example 1 was repeated, except that a conventional brush roll made of a monofilament of nylon 12 was used.

The results are also shown in Table 1.

TABLE 1

| Example No. | Number of retained particles (particles/10 cm$^2$) particle size <5 μm | 5 to 30 μm | >μm | Scratch marks |
|---|---|---|---|---|
| 1 | 28 | 19 | 0 | None |
| 2 | 36 | 28 | 2 | None |
| Comparative | 320 | 52 | 12 | Appeared |

We claim:

1. A method for thorough cleaning of a finely finished surface of an article of glass or metal by removing cuttings, shavings, turnings, abrasive grains and fine particles from said surface, comprising scrubbing said surface by means of a cleaning roll having a surface layer of polyvinyl acetal porous elastic material having a porosity of 85% to 95%, an average pore opening of 10 to 200 μm, and a 30% compression stress, at a water content of 100% based on the dry weight of the material, of 15 to 150 g/cm$^2$, whereby said surface is thoroughly cleaned of even fine particles without causing damage to the fine finish of said surface.

2. A method as claimed in claim 1, wherein the surface layer of the polyvinyl acetal porous elastic material of the cleaning roll is flat.

3. A method as claimed in claim 1, wherein the surface layer of the polyvinyl acetal porous elastic material of the cleaning roll is gear-like in configuration, having many parallel grooves formed at an angle to the roll axis of 0° to 90°.

4. A method as claimed in claim 1, wherein the surface layer of the polyvinyl acetal porous elastic material of the cleaning roll is of a configuration having many projections of a prescribed shape.

5. A method as claimed in claim 1, wherein the scrubbing is carried out in the presence of water, an aqueous detergent solution, or an organic solvent.

6. The method as claimed in claim 1, wherein the fine particles being removed have a diameter of less than 5 μm.

* * * * *